United States Patent [19]

Froehlich

[11] 4,014,639

[45] Mar. 29, 1977

[54] RECIRCULATING VORTEX BURNER

[75] Inventor: Harold E. Froehlich, Minneapolis, Minn.

[73] Assignee: Minnesota Mining and Manufacturing Company, St. Paul, Minn.

[22] Filed: Apr. 10, 1975

[21] Appl. No.: 566,712

[52] U.S. Cl. ..... 431/353; 431/182; 431/115; 239/406

[51] Int. Cl.[2] ..... F23D 15/02

[58] Field of Search ..... 431/115, 116, 182, 183, 431/353; 239/404–406

[56] References Cited

UNITED STATES PATENTS

| | | | |
|---|---|---|---|
| 1,101,723 | 6/1914 | Bailey et al. | 431/183 |
| 1,230,725 | 6/1917 | Kraus | 239/405 |
| 2,765,842 | 10/1956 | Lake | 239/404 |
| 2,879,836 | 3/1959 | Dumas | 431/183 |
| 3,365,136 | 1/1968 | Hoffman | 239/417.3 |
| 3,748,087 | 7/1973 | Shular | 431/182 |

OTHER PUBLICATIONS

Conference Paper CP65–1, 1965 API Research Conference on Distillate Fuel Combustion, June 1–3, 1965, Chicago, Illinois, Recirculation in a Vortex–Stabilized Oil Flame by R. E. Schindler and W. E. Ranz, Univ. of Minnesota, Minneapolis, Minnesota.

*Primary Examiner*—Carroll B. Dority, Jr.
*Attorney, Agent, or Firm*—Cruzan Alexander; Donald M. Sell; G. Brian Pingel

[57] ABSTRACT

A recirculating vortex burner wherein liquid fuel is vaporized in suspension by recirculating hot products of combustion and is thoroughly mixed with air in order that substantially carbon-free combustion occurs. The burner employs a combustion chamber into which air is supplied at one end by a plurality of fixed orifices that provide air jets for producing a spiraled swirling flow pattern in the chamber. Such flow pattern establishes a stable vortex with a relatively low pressure region in the chamber central portion and results in substantial recirculation of the products of combustion. The air jets intersect fuel sprayed into the chamber and entrain such fuel together with the recirculating products of combustion so that air, fuel and products of combustion are thoroughly mixed and the fuel is substantially gasified prior to combustion.

11 Claims, 6 Drawing Figures

RECIRCULATING VORTEX BURNER

BACKGROUND OF THE INVENTION

1. Field of the Invention

Heretofore, the most common liquid fuel burners for furnaces, incinerators, boilers, gas turbines and jet engines have used air vanes to swirl air for combustion around a region where fuel is injected into the combustion chamber. Such burner systems employ various flow patterns within their combustion chambers, but none have employed large scale recirculation of products of combustion and a subsequent mixing with fuel to produce substantial fuel gasification. Yet without such recirculation and mixing to produce gasification, typical vane swirl burners pyrolyze a portion of the fuel to be burned and form carbon within the flame. Fuel pyrolization results in a luminous prematurely ignited and incompletely mixed flame containing unburned carbon particles.

Vaporization of fuel prior to combustion has been employed in various burners by using a separate fuel vaporizing chamber or additional ducting serving solely to provide recirculation and consequent gasification of fuel. Also, a swirl burner that achieved fuel gasification prior to combustion by recirculation of products of combustion is described in Schindler and Ranz, *Recirculation in a Vortex-Stabilized Oil Flame*, 1965 API Research Conference on Distillate Fuel Combustion, Conference Paper CP 65-1. Such burner was built by the University of Minnesota and utilized combustion product recirculation to produce gaseous combustion of No. 2 fuel oil. Swirl in the University of Minnesota burner was caused by using a nozzle block that was rotated at high speeds (4000–5000 RPM) and included 212 circular air orifices. A fine mesh screen was disposed above the orifices to eliminate excessive divergence of the air jets emanating therefrom.

The present invention differs from the above described burners in that no rotating parts, vaporizing surfaces or separate vaporizing chambers are located within the burner and no ducting is employed to route recirculating products of combustion. Yet the present invention provides recirculation of a substantial portion of the products of combustion for vaporizing primarily all fuel introduced into the combustion chamber, and also provides thorough fuel, combustion products and air mixing in order that combustion is maintained with less than, equal to or more than stoichiometric quantities of fuel and air, as desired, to achieve a predominantly blue, clean burning flame.

SUMMARY OF THE INVENTION

The present invention provides a recirculating vortex burner for producing a clean burning smokeless flame and includes a combustion chamber, a conduit means leading to an intake port of the chamber, a swirl member disposed in the intake port of the chamber for restricting and directing air flow into the chamber from the conduit means and having a central bore surrounded by a plurality of spaced apart inlet air orifices, and a fuel nozzle disposed in the central opening of the swirl member.

The fuel nozzle is adapted to provide a conical fuel spray that intersects air jets entering the combustion chamber from the orifices in the swirl member. Such orifices are directed on an incline through the swirl member and are tangential to its central opening. The incoming air jet streams produce a spiraled swirling flow for establishing a vortex in the combustion chamber, and such flow has a jet attachment to the interior wall of the combustion chamber to produce a broad low pressure region in the central portion of the cylinder with the center of the low pressure region located immediately above the swirl member. Consequently, over 50 percent of the products of combustion are recirculated into the vortex low pressure region before being exhausted. The recirculating combustion products are thoroughly mixed with the fuel through entrainment in the air jets. The high temperature of the recirculating combustion products that mix with the incoming liquid fuel produces vaporization of the fuel so that combustion occurs as a gaseous blue flame reaction consuming less than, equal to or more than stoichiometric quantities of fuel and air as desired.

DESCRIPTION OF THE PREFERRED EMBODIMENTS

Figure 1:
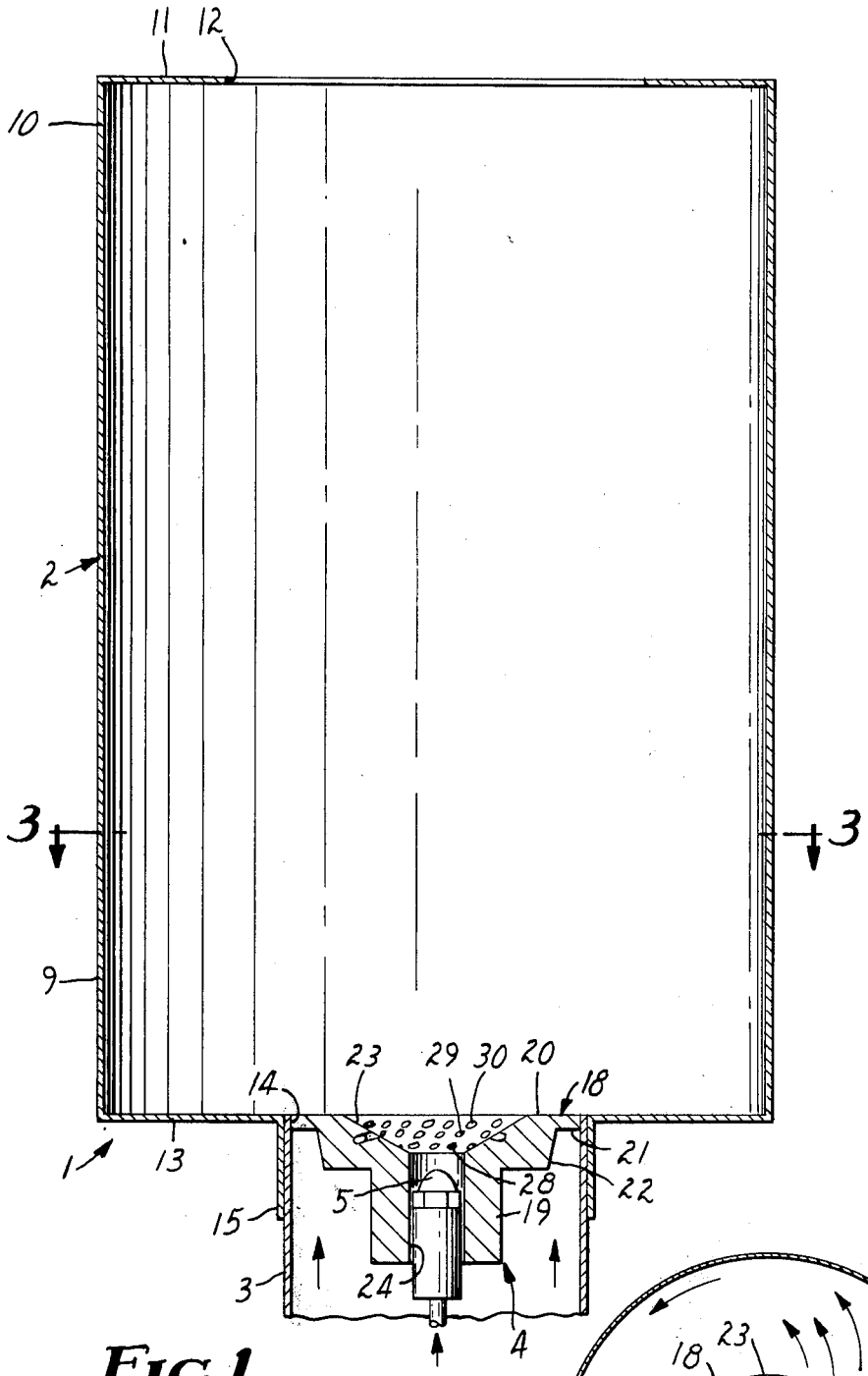
FIG. 1 is a longitudinal cross sectional view of a preferred embodiment of the burner of the present invention.

Referring now to the drawings, a preferred embodiment of the present invention is shown in FIG. 1 in the form of a recirculating vortex burner 1 that is particularly advantageous for use with liquid fuels such as gasoline, kerosine and Nos. 1 and 2 heating fuel and diesel oils. However, the present invention is not restricted to such use, and it is believed that the inventive features disclosed herein may be applied in burners using other types of fuels such as natural gas, propane, powdered coal, residual fuel oils or liquid fuels having high sludge content.

The burner 1 includes a combustion chamber 2, an air blast tube 3, an air swirl member 4 and a fuel nozzle 5. During combustion, the combustion chamber 2 is exposed to high temperatures of approximately 1200°–1300° F. and it is therefore advantageous that the chamber 2 is insulated or is made from a heat resistant material such as stainless steel. The combustion chamber 2 is preferably cylindrically shaped to provide a smooth rounded interior that aids in supporting a swirling flow pattern in the chamber 2, but chambers having other type cross sections such as octagons, hexagons or squares may be employed.

The combustion chamber 2 has a mixing end 9 and an exhaust end 10. Preferably, the exhaust end 10 is partially closed off by an end wall 11 having a circular central opening 12 that serves as an exhaust port for combustion products. However, a single central circular shaped exhaust port is not the only form of port that can be used and an exhaust port or ports may be formed in the end 10 in various locations and configurations. For example, a plurality of exhaust ports may be formed in the end wall 11 or in the sides of the chamber 2 near the end wall 11; also, an exhaust port in the form of an annulus in the end wall 11 may be used, or the end 10 may be completely open. Primarily, the shape or location of the exhaust port or ports in the end 10 is dependent upon the length of the combustion chamber 2 as will be described in detail below. The mixing end 9 is partially closed by an end wall 13 with a centrally located intake port 14 having an external flange 15 about its periphery that defines a seat for the air blast tube 3.

The air blast tube 3 serves as a conduit means to convey air from a source of low pressurized air of preferably between a range of 0.01 – 0.3 P.S.I., to the swirl member 4. Thus, the burner 1 does not require a high pressurized air source but, if desired, higher pressures than the foregoing range may be employed. The swirl member 4 is seated in a fixed position to close off the intake port 14 and is formed from such materials as alumunim, brass, cast iron or low carbon steel. The member 4 preferably has a substantially circular head 18 and a tubular body 19, as shown most clearly in FIGS. 2, 4–6. The head 18 has an upper face 20 that is substantially flush with the interior surface of the end wall 13, and a lower exterior portion of the head 18 is recessed to form a tiered configuration that includes an upper flange 21 and a lower shoulder 22. The central portion of the head 18 is dished to form a recess 23 in the shape of a frustum, the innermost portion of which terminates in a cylindrical bore 24 that extends downward through the center of the swirl body 19.

The swirl member 4 preferably has three circular rows of orifices 28, 29 and 30, each row comprised of spaced apart orifices that serve as passages from the lower shoulder 22 to the recess portion 23. The orifices 28, 29 and 30 are directed through the member 4 on an angle to the longitudinal axis of the bore 24 and are tangential to the bore 24 in that they are parallel to a plane that contains lines tangent to the bore 24 and also lie in planes parallel to the axis of the bore 24. In optimum operation the orifices 28, 29 and 30 should be at an inclination of less than 45° with respect to the upper face 20 of the swirl head 18. The orifices 28, 29 and 30 should be sufficiently long to initially direct the air jets emanating therefrom on a line that coincides with the longitudinal axes of the orifices. Preferably the swirl member 4 has equal numbers of orifices 28, 29 and 30 and each row of orifices 28, 29 and 30 is disposed in a staggered relationship with respect to those of the other rows in order that the jets of air emanating from the orifices 28, 29 and 30 lap together to act in concert for producing a spiraled swirling flow pattern in the chamber 2. However, various other arrangements and numbers of orifices may be employed with satisfactory results and in fact as few as one circular row of four orifices may be employed. Furthermore, the dished recess 23 in the swirl member head 18 is not essential to the present invention but is desirable because it enhances the formation of the swirling flow pattern in the chamber 2.

Positioned in the bore 24 of the swirl member 4 is a fuel nozzle 5 that preferably provides a 90° hollow cone fuel spray from a source of fuel pressurized for optimum operation at between 20 – 100 or more P.S.I. The nozzle 5 blocks the bore 24 to prevent air from the tube 3 from passing therethrough. The fuel spray provided by the nozzle 5 is directed outward from the bore 24 to intersect the jets of air emanating from the orifices 28, 29 and 30 in the swirl member 4 in order that there is substantial entrainment of fuel in the jets of air to provide thorough mixing of air and fuel. The orifices 28, 29 and 30 are spaced sufficiently apart that initially each air jet emanating therefrom acts independently in entraining and mixing with fuel. Mixing between air and fuel is aided by the use of the recess 23 in the swirl member head 18 to permit the nozzle 5 to be axially offset with respect to the orifices 28, 29 and 30 so that the nozzle 5 is further from the interior of the chamber 2 than are the orifices. Such positioning of the nozzle 5 insures that optimum intersection of fuel and air is achieved. The amount of air and fuel mixing in the chamber 2 is a highly critical aspect of the present invention because without sufficient mixing, incomplete combustion will result.

To further aid in providing optimum air and fuel mixing preferably the orifices 28, 29 and 30 are sized to provide air jets that are preferably turbulent or very nearly turbulent. This is because entrainment of fuel by turbulent jets far exceeds the entrainment provided by laminar jets. In contrast to such flow the orifices 28, 29 and 30 are adapted to provide air jets having main stream lines that are fairly strong but yet produce a turbulence in the mixing end 9 of the chamber 2 commonly referred to as free turbulence. Air eddies are associated with such turbulence and are directly responsible for high entrainment of fuel in the air jets and mixing between the air and fuel.

When combustion is initiated in the chamber 2, it is first fed by fuel directly supplied by the fuel nozzle 5 in atomized form. Such combustion is incomplete because the air provided through the orifices 28, 29 and 30 cannot fully react with the atomized droplets. However, swirl created by the incoming air causes the rapid establishment of a relatively low pressure region that is centered directly above the bore 24 of the swirl member 4 and the majority of the hot products of combustion recirculate into this region rather than exiting through the exhaust port 12. Thereupon, the recirculating combustion products are entrained and mixed with incoming fuel by the air jets of the orifices 28, 29 and 30. Mixing of the fuel with the hot combustion products immediately causes gasification of fuel, but combustion is delayed because the velocity of the air jets exiting from the orifices 28, 29 and 30 is above the flame propogation velocity to preclude combustion in the atomized fuel droplet region.

Figure 3:
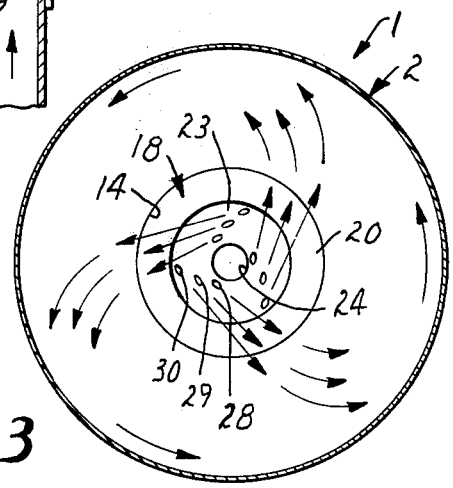
FIG. 3 is a reduced cross sectional view of the burner of FIG. 1 taken along the line 3—3 of FIG. 1 and showing only a selection of the orifices of the swirl member of FIG. 2 for purposes of clarity.
Figure 2:
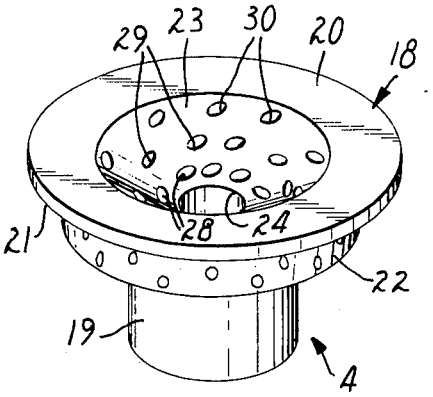
FIG. 2 is a perspective view of swirl member employed in the burner of FIG. 1 and having a plurality of orifices.
Figure 4:
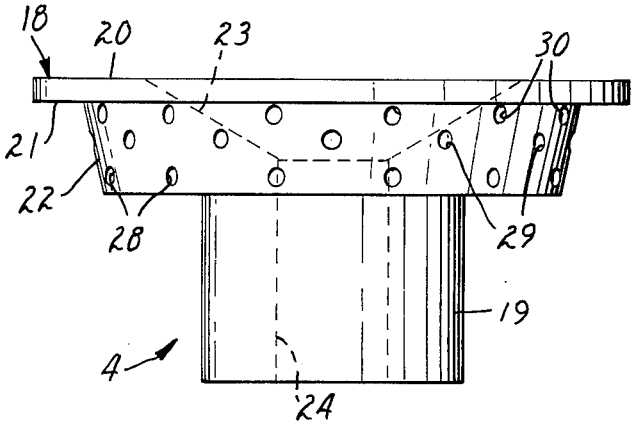
FIG. 4 is a side view of the swirl member of FIG. 2.
Figure 6:
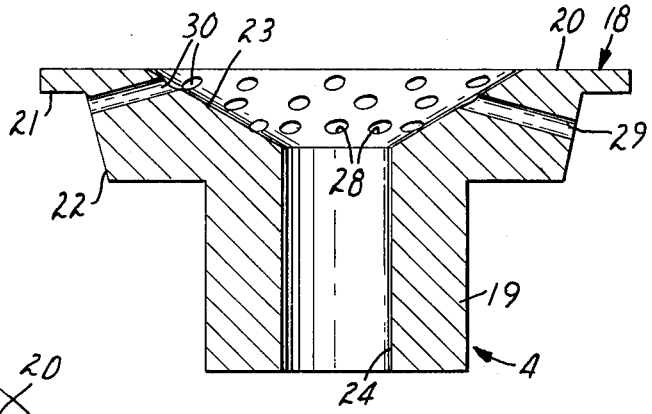
FIG. 6 is a cross sectional view of the swirl plate of FIG. 2 taken along the line 6—6 of FIG. 5.
Figure 5:
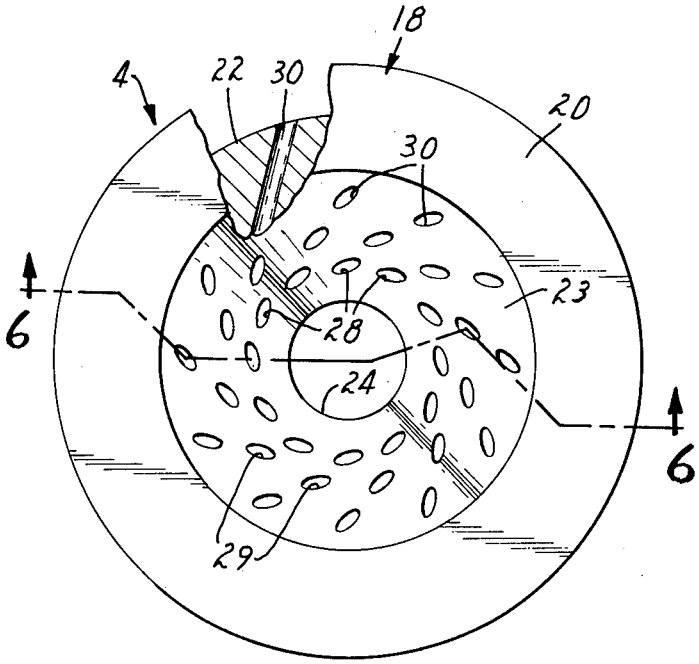
FIG. 5 is a top view of the swirl member of FIG. 2 with portions cut away to fully expose an orifice formed therein.

The momentum of the incoming air is much greater than the momentum of the fuel spray. Therefore, the air jets dominate and determine the resultant flow direction of the mixed air, fuel and combustion products. As the air jets of the orifices 28, 29 and 30 travel downstream in the combustion chamber 2, their velocity decreases and they expand and merge and coalesce together. Also, they begin to turn (or swirl), as indicated in FIG. 3, due to the confining aspect of the generally cylindrical configuration of the combustion chamber 2 and the fact that all the jets are offset from the axial center line thereof. As the air jets begin to turn combustion occurs in a swirling annular path.

As combustion occurs a six fold volumetric expansion of air and fuel results to produce flow acceleration that supplements the flow velocity from the orifices 28, 29 and 30 and creates further turbulence and mixing. The diameter of the chamber 2 preferably is 1.5 to 3 or more times the diameter of the swirl member 4 in order that the high entrainment of fuel and recirculating combustion products by the incoming air results in a jet attachment of the swirling recirculating combustion products to the side wall of the chamber 2 and thereby provides maximum expansion of the low pressure region in the central portion of the chamber 2. At optimum operation the pressure of the central portion of the chamber 2 is sufficiently low that more than 50 percent recirculation of the products of combustion is achieved. As a result, during combustion fuel and air may be consumed in proportions less than, equal to, or more than stoichiometric quantities, as desired.

The amount of recirculation of products of combustion that occurs in the chamber 2 is dependent not only on the amount of swirl existing in the chamber 2 and the degree of jet attachment of the swirl to the sidewall of the chamber 2, but also upon the type of exhaust port or ports of the exhaust end 10 and the length of the chamber 2. The combustion chamber 2 is preferably sized to allow for the entraining and mixing of air, fuel and products of combustion to occur primarily within the mixing end 9 and to allow much of the products of combustion to recirculate several times before being exhausted. If the area of the exhaust port 12 is decreased, recirculation of combustion products can be increased. Accordingly, if the chamber 2 is increased in length the area of the exhaust port 12 may also be increased because there will be more space and time for the occurrence of recirculation before the products of combustion reach the exhaust end 10. Correspondingly, if the length of the combustion chamber 2 is decreased the area of the exhaust port 12 should also be decreased. If the length of the cylinder 2 is short (less than 1½ times the diameter of the cylinder 2), it is advisable that the central exhaust port 12 not be employed in the end of the chamber 2 because the pressure of the low pressure region causes back flow into the chamber 2 through the exhaust port 12. To prevent such back flow an annularly shaped exhaust port is preferably used.

Although the majority of the fuel emitted by the nozzle 5 forms a hollow cone about the periphery of the vortex region, some fuel is emitted into the low pressure central region of the chamber 2. However, substantially no combustion occurs in this region because it does not have sufficient air to feed combustion and instead the combustion region substantially occurs in a toroidally shaped region surrounding the swirl member 4. Accordingly, it is likely that it would be possible to use a fuel nozzle 5 that provides a conical fuel spray without a hollow core.

The following example is described for the purpose of illustration only and not of limitation.

EXAMPLE

A burner system as shown in FIG. 1 was formed and included the combustion chamber 2, the blast tube 3, the swirl member 4 and the fuel nozzle 5. The combustion chamber 2 was cylindrically formed of stainless steel and had a 9 in. diameter and a length of 14 in. A single 6 in. diameter exhaust port 12 was formed in the center of the exhaust wall 11 of the cylinder 2, and a 4 in. intake port 14 was formed in the mixing end wall 13. The swirl member 4 was formed from aluminum and included three rows of 12 equally sized orifices 28, 29 and 30, 0.12 in. in diameter. The orifices 28, 29 and 30 were directed through the swirl member 4 substantially as tangents to circles coaxial with the bore 24 and having diameters of 2 in., and 1⅝ in., and 1¼ in. respectively. Also the orifices 28, 29 and 30 were inclined at an angle of 15° with respect to the upper face of the swirl head 18. The pressure of air supplied by the blast tube 3 to the swirl member 4 was at approximately 0.036 P.S.I. The fuel nozzle 5 provided a 90° hollow cone fuel spray at the rate of 0.3 gallons per hour and fuel was supplied to the nozzle 5 at 60 P.S.I. of pressure. Clear, blue flame combustion was achieved in the chamber 2 and produced a vortex having a low pressure central region at approximately 0.001 P.S.I. below the pressure existing at the periphery of the vortex.

What is claimed is:

1. A recirculating vortex burner comprising in combination:

a substantially cylindrical combustion chamber having an intake port forming a portion of one end and at least one exhaust port at or near an opposite end;

a conduit means leading to the intake port of said chamber;

a swirl member disposed in the intake port of the combustion chamber to restrict air flow from said conduit means to said chamber, said swirl member having a central opening and a plurality of spaced apart inlet orifices circumferentially disposed around said opening and directed through said swirl member tangentially to said opening and at an incline to the longitudinal axis of said central opening to communicate between said conduit means and said combustion chamber whereby air can be directed through said orifices in said swirl member into said combustion chamber; and a fuel nozzle disposed in the central opening of said swirl member for providing a conical fuel spray that intersects the air flow entering said combustion chamber through said swirl member orifices, said fuel nozzle and said swirl member cooperating together to seal off the intake port of said combustion chamber whereby air from said conduit enters said chamber solely through said orifices.

2. A burner as recited in claim 1 wherein said swirl member further includes at one end a central concave recess that terminates in the central opening of said member, and said inlet orifices form passages from the outer periphery of the swirl memeber to said recess.

3. A burner as recited in claim 1 wherein the air that is directed through said orifices into said combustion chamber produces a spiraled swirling flow pattern that establishes a vortex with a low pressure area in the central portion of the chamber whereby a majority of the products of combustion recirculate into the low pressure area and are mixed with fuel supplied by said fuel nozzle and the air from said orifices, and act to gasify said fuel prior to combustion to produce a clean burning blue flame.

4. A burner as recited in claim 1 wherein said swirl member includes a plurality of rows of spaced apart rows of orifices, with the orifices of each row being staggered with respect to those of the other rows.

5. A burner as recited in claim 1 wherein said burner operates with substantially a carbon-free flame with less than, equal to, or more than stoichiometric proportions of fuel and air.

6. A burner as recited in claim 1 wherein the distance from the interior of said combustion chamber to said fuel nozzle is greater than the distance from the interior of the chamber to said orifices.

7. A recirculating vortex burner for producing a clean burning smokeless flame, said burner comprising:

a substantially cylindrical combustion chamber having an intake port forming a portion of one end and at least one exhaust port at or near an opposite end;

a conduit means leading to the intake port of said chamber;

a swirl member disposed in the intake port of the combustion chamber to restrict air flow from said conduit means to said chamber, said swirl member having a central opening and a plurality of spaced inlet orifices tangentially and circumferentially disposed around said opening and directed through said swirl memeber at an incline to the longtudinal axis of said central opening and in planes parallel to the axis of said opening, said orifices having a sufficient length that air jets exiting therefrom are initially directed along an axis coincident with the axis of the orifices whereby air can be directed through said conduit means and said orifices in said swirl member into said combustion chamber; and a fuel nozzle connected with said pressurized fuel source and disposed in the central opening of said swirl member for providing a conical fuel spray that intersects the air entering said combustion chamber through said swirl member orifices, said fuel nozzle and said swirl member cooperating together to seal off the intake port of said combustion chamber whereby air from said conduit enters said chamber solely through said orifices.

8. A burner as recited in claim 1 wherein the exhaust port of said combustion chamber is at least partially closed off.

9. A burner as recited in claim 1 wherein the orifices of said swirl member are of a size to provide substantially turbulent air flow therethrough.

10. A burner as recited in claim 1 wherein the diameter of said combustion chamber is approximately 1.5 to 3 times greater than the diameter of said swirl member.

11. A burner as recited in claim 1 wherein the length of said combustion chamber is at least 1½ times the diameter of said chamber and the exhaust port of said chamber is in the form of a central opening in said opposite chamber end.

* * * * *